US006493917B1

(12) United States Patent
Sunka

(10) Patent No.: US 6,493,917 B1
(45) Date of Patent: Dec. 17, 2002

(54) COMPACT SPACE ORGANIZATIONAL SYSTEM

(76) Inventor: Susan Sunka, 647 Birgham Pl., Lake Mary, FL (US) 32746

( * ) Notice: Subject to any disclaimer, the term of this patent is extended or adjusted under 35 U.S.C. 154(b) by 138 days.

(21) Appl. No.: 09/651,663

(22) Filed: Aug. 29, 2000

(51) Int. Cl.[7] ..... B23P 17/00

(52) U.S. Cl. ..... 29/413; 220/529; 220/552; 220/528; 312/348.3; 403/217; 403/294; 29/450

(58) Field of Search ..... 220/529, 552, 220/4.28, 528; 446/112, 114, 116, 118, 111; 403/294, 217, 169, 170; 211/184; 312/348.3, 193

(56) References Cited

U.S. PATENT DOCUMENTS

| | | | | | |
|---|---|---|---|---|---|
| 869,833 | A | * | 10/1907 | Ferres | 229/125.19 |
| 1,211,760 | A | * | 1/1917 | Rothweiler | 217/65 |
| 2,607,972 | A | * | 8/1952 | Rust | 403/403 |
| 3,108,696 | A | * | 10/1963 | Winner | 211/73 |
| 3,153,299 | A | * | 10/1964 | Jennings | 446/127 |
| 3,301,582 | A | * | 1/1967 | Linecker | 52/655.1 |
| 3,389,666 | A | | 6/1968 | Shultz-Bonatz | 108/7 |
| 3,469,335 | A | * | 9/1969 | Leigh | 40/607 |
| 4,257,207 | A | * | 3/1981 | Davis | 52/578 |
| 4,258,856 | A | * | 3/1981 | Marling | 217/7 |
| 4,261,464 | A | | 4/1981 | Maitland | 206/334 |
| 4,675,970 | A | * | 6/1987 | Galen | 108/61 |
| 4,787,553 | A | * | 11/1988 | Hoskins | 229/918 |
| 5,242,223 | A | | 9/1993 | Koves | 321/348 |
| 5,289,941 | A | | 3/1994 | Blankenburg et al. | 220/552 |
| 5,423,604 | A | | 6/1995 | Chern | 312/265.1 |
| 5,484,078 | A | * | 1/1996 | Bronovicki | 220/531 |
| 5,582,305 | A | * | 12/1996 | Howell et al. | 211/126.1 |
| 5,810,187 | A | | 9/1998 | Woodring | 220/23.86 |
| 5,853,239 | A | | 12/1998 | Laib et al. | 312/348.2 |
| 6,073,794 | A | | 6/2000 | Bidot | 220/529 |
| 6,085,452 | A | * | 7/2000 | Davis | 40/606 |

* cited by examiner

*Primary Examiner*—Nathan J. Newhouse
*Assistant Examiner*—Joseph C. Merck
(74) *Attorney, Agent, or Firm*—Brian S. Steinberger; Law Offices of Brian S. Steinberger, P.A.

(57) ABSTRACT

Organizational system for forming customized compartments for compact spaces. A plastic type sheet has preperforations formed thereon, for allowing different sized walls and/or floors to be separated therefrom. The sheet can be a thin plastic having side indentations along its edges. Corner connectors can be originally supplied where individual connectors each have four prong prongs/tabs of flat triangular shapes arranged approximately ninety degrees from one another in a cross-shape. Walls/floors can be attached to one another by inserting the prongs/tabs into the side indentations of other walls/floors. The prongs/tabs can separated from the others depending on whether an installer wishes to use a connector to attach two walls/floors together, three walls/floors together or four walls/floors together. When the system is used to make divider walls, other portions can be attached to make a floor for the walls. When the system is used to make divider shelves, other portions can be attached thereon to make a rear wall for the shelves. Another embodiment uses corrugated plastic sheet of preperforated sections and the prongs/tabs being cylindrical and/or as appendages with narrow tips. The system can make customized compartments for drawers, under-the-counter spaces, shelves, storage boxes/containers for clothing, tools, various accessories, and the like, having various heights, lengths, widths and sizes.

15 Claims, 10 Drawing Sheets

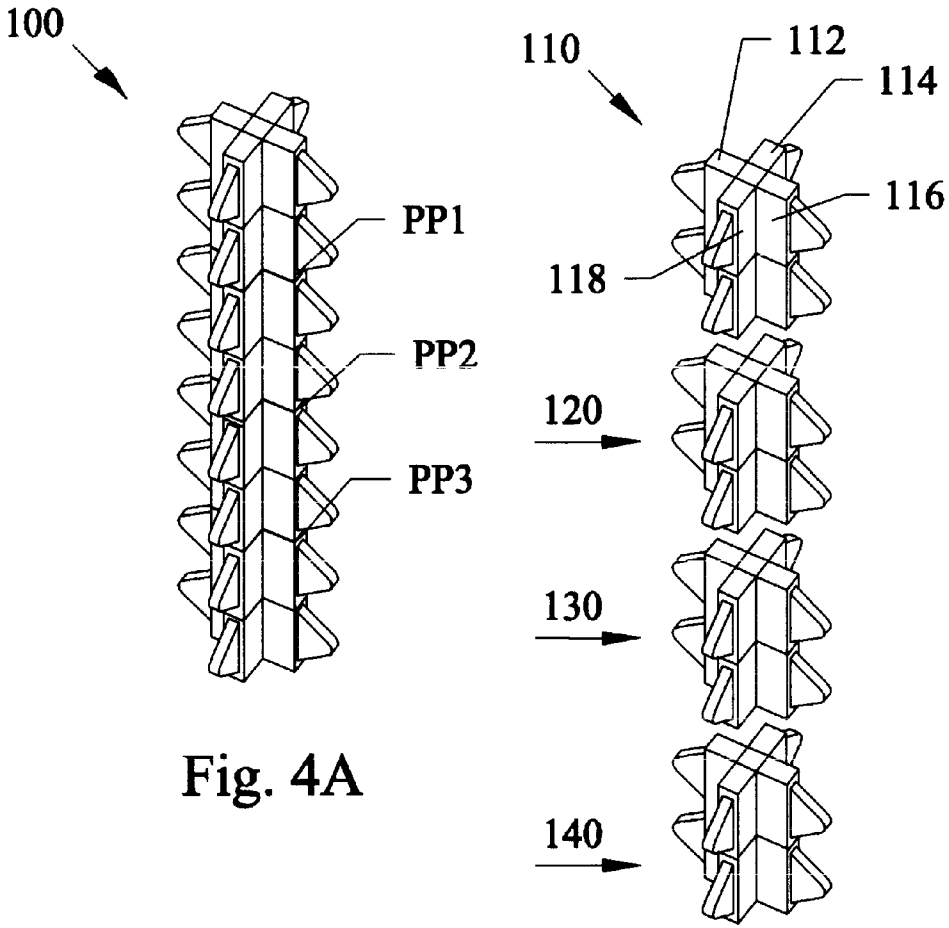
Fig. 4A
Fig. 4B
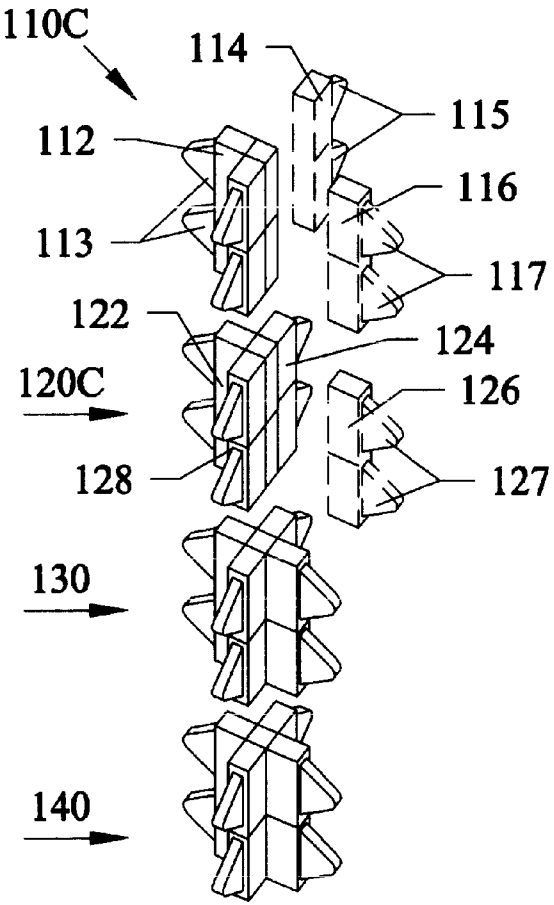
Fig. 4C

COMPACT SPACE ORGANIZATIONAL SYSTEM

This invention relates to an organizational system that can be utilized in compact spaces, which includes but is not limited to drawers, under-the-counter spaces, shelves, storage boxes/containers for clothing, tools, various accessories, and the like. The system consists of pre-perforated sheets in which divider wall and/or floor sections can be measured and separated according to the user's needs, and the individual wall/floor sections can be connected to one another by inserting prongs/connectors into indentations/sides of the wall/floor sections, and where divider walls can have a floor, and where different floor-shelves can have a backing wall.

BACKGROUND AND PRIOR ART

Organizers having fixed compartments have been used for many years. However, the fixed molded compartment organizers limit the size of the compartments to make them unusable for all items that may be stored therein. Furthermore, the fixed size organizers predominately used for drawers can be either too small for large drawers or too big for fitting into small drawers.

Various types of adjustable organizers predominantly designed for drawers have been proposed over the years. See for example, U.S. Pat. Nos. 4,261,464 to Maitland; 5,242,223 to Koves; 5,289,941 to Blankenburg et al.; 5,810,187 to Woodring; 5,853,239 to Laib et al.; and 6,073,794 to Bidot. However, these devices generally require multiple pieces that must be separately formed resulting in expensive manufacturing costs. Also, the more pieces required the greater the chance one or more pieces may be lost resulting in incomplete organizers. Additionally, many of these devices require thick parts to connect together that would reduce the space for storage within the drawers. Still furthermore, these devices generally require walls having one height, and would not be versatile for drawers of narrow depths and large depths.

SUMMARY OF THE INVENTION

The first objective of the present invention is to provide an organizational system for compact spaces that use few pieces to construct.

The second object of this invention is to provide an organizational system for compact spaces that are easy to assemble.

The third object of this invention is to provide an organizational system for compact spaces that are inexpensive to manufacturer.

The fourth object of this invention is to provide an organizational system for compact spaces that can have different wall heights and lengths.

The fifth object of this invention is to provide an organizational system for compact spaces that can be customized to fit any compact space, which includes but is not limited to drawers, under-the-counter spaces, storage boxes/containers for clothing, tools, various accessories, and other compact spaces, and the like.

The sixth object of this invention is to provide an organizational system for compact spaces that can create customized compartments.

The seventh objective of this invention is to provide the option of including a bottom/floor to individualized compartments within the organizational system.

The eighth objective of this invention is to provide the option of including a backing wall to individualized shelf compartments within the organizational system.

A preferred embodiment of the organizer for compact spaces include a thin plastic type sheet being pre-perforated so that individual pieces can be separated therefrom. An installer breaks off various desired wall sections of variable heights and lengths depending on the size of the drawer and the organizational compartments that are desired.

A row of individual connectors can also be provided where the connectors can be detached from one another by having pre-perforated edges between each of the connectors. Each of the connectors has prongs/tabs that are inserted into side indentations of the wall sections to create dividers that can be inserted into drawers. Originally, each of the connectors can have four prongs/tabs arranged perpendicular to one another. The installer can also detach(separate and break off) unneeded prongs/tabs when attaching two walls or three walls together as compared to attaching four walls together.

The plastic type sheet can have flat faces on both sides and side indentations running there-through. Another type of sheet can be corrugated type plastic having flat faces and corrugated spaces running through similar to that found in corrugated cardboard.

The connectors can have various types of prongs/tabs such as flat faced triangular shapes, cylindrical shapes and the like, where the prongs/tabs can be mateably inserted into side spaces on the wall sections to form tight fits connections. The prongs/tabs can be made to form permanent wall dividers by having hook edges that allow the prongs/tabs to snap within mateable indentations. Alternatively, the tabs/prongs can be made to have tight fits but be reusable so that an installer can pull the wall dividers apart from one another and used to form different sized drawer compartments.

Further objects and advantages of this invention will be apparent from the following detailed description of a presently preferred embodiment which is illustrated schematically in the accompanying drawings.

BRIEF DESCRIPTION OF THE FIGURES

FIG. 4A shows a perspective view of a row of four prong corner connectors.

FIG. 4B shows the row of corner connectors of FIG. 4A snapped apart along its axis.

FIG. 4C shows the corner connectors of FIGS. 4A–4B with side tabs snapped off

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
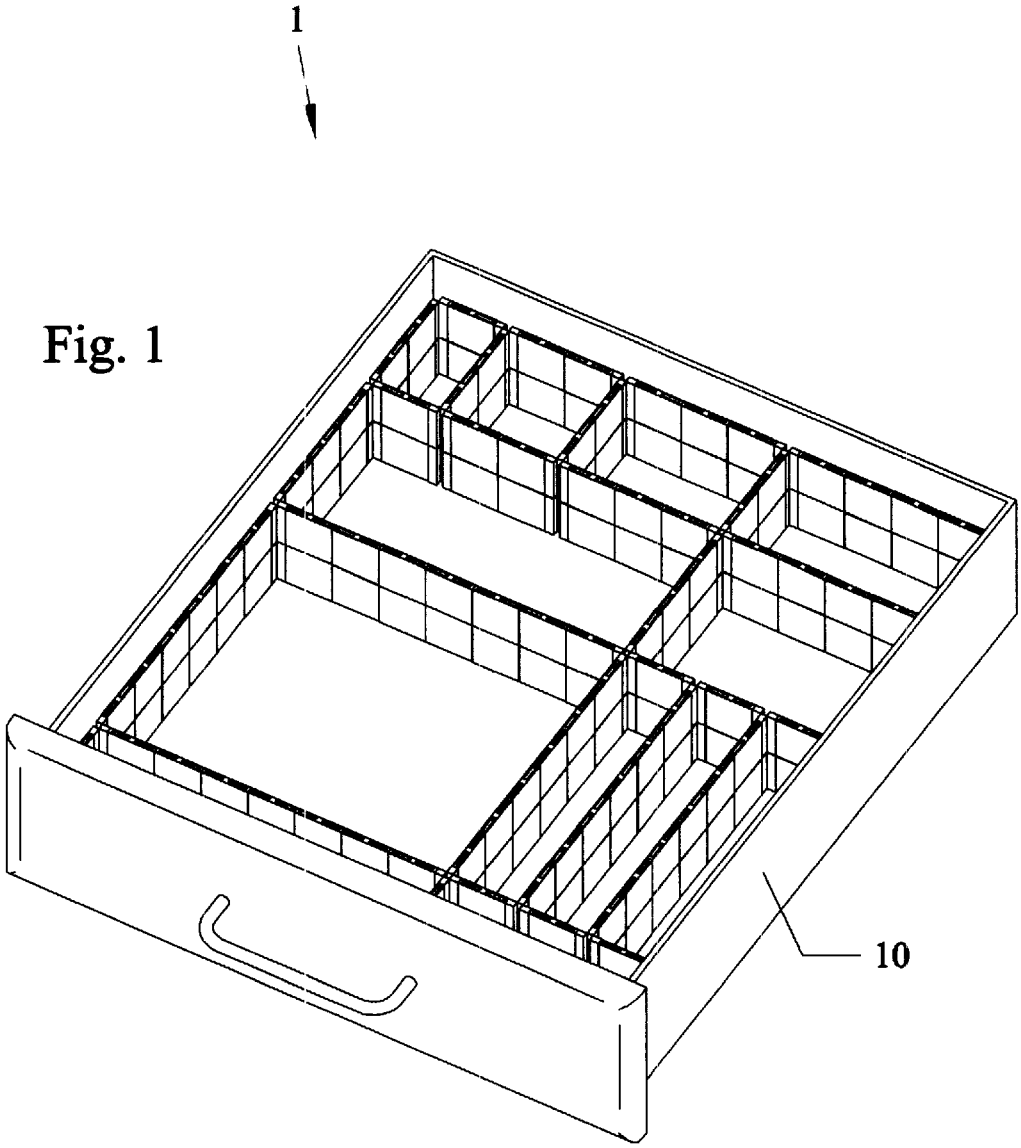
FIG. 1 the novel invention organizer assembled inside of a drawer.
Figure 2:
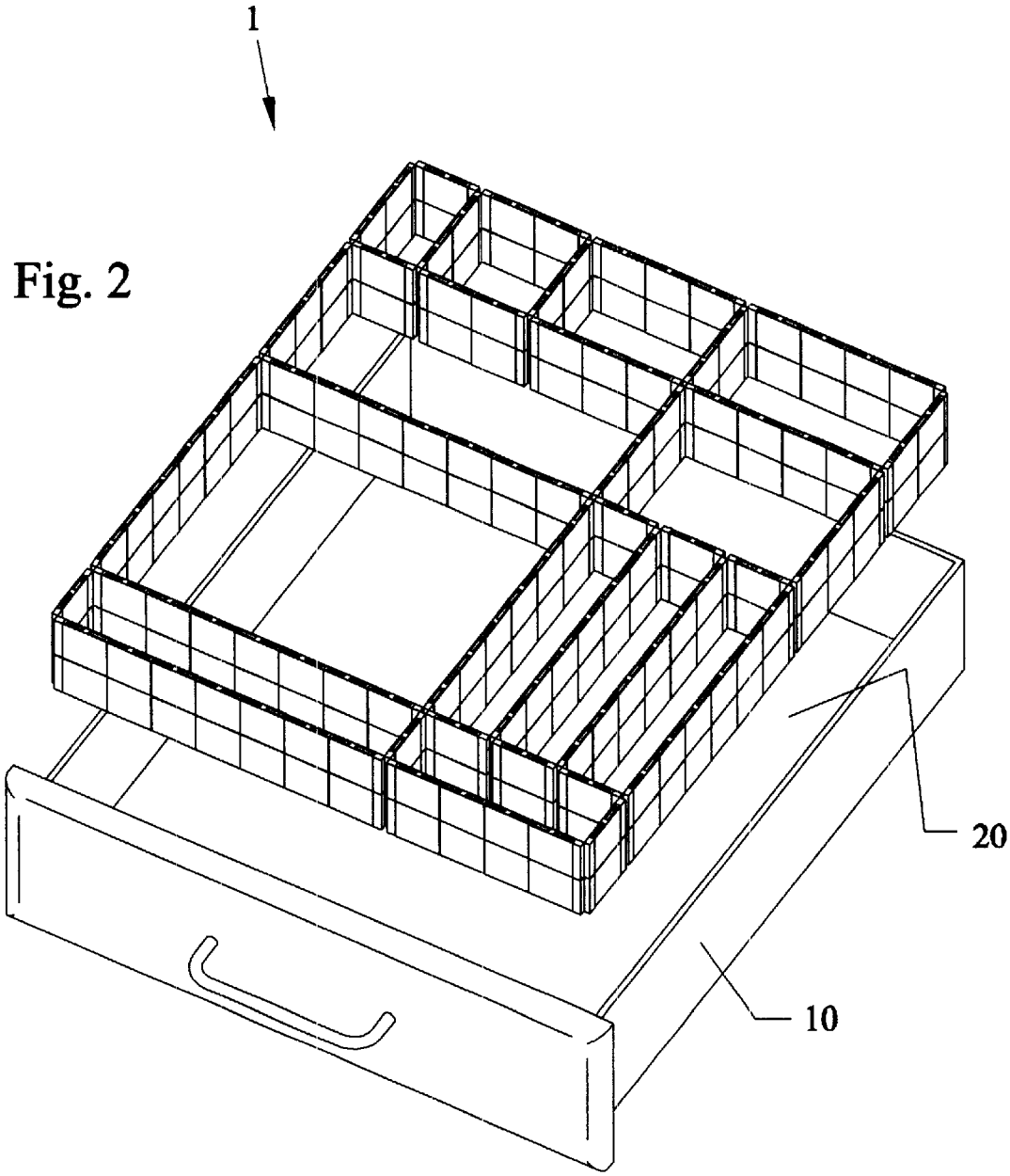
FIG. 2 shows the organizer of FIG. 1 separated from the drawer.
Figure 3:
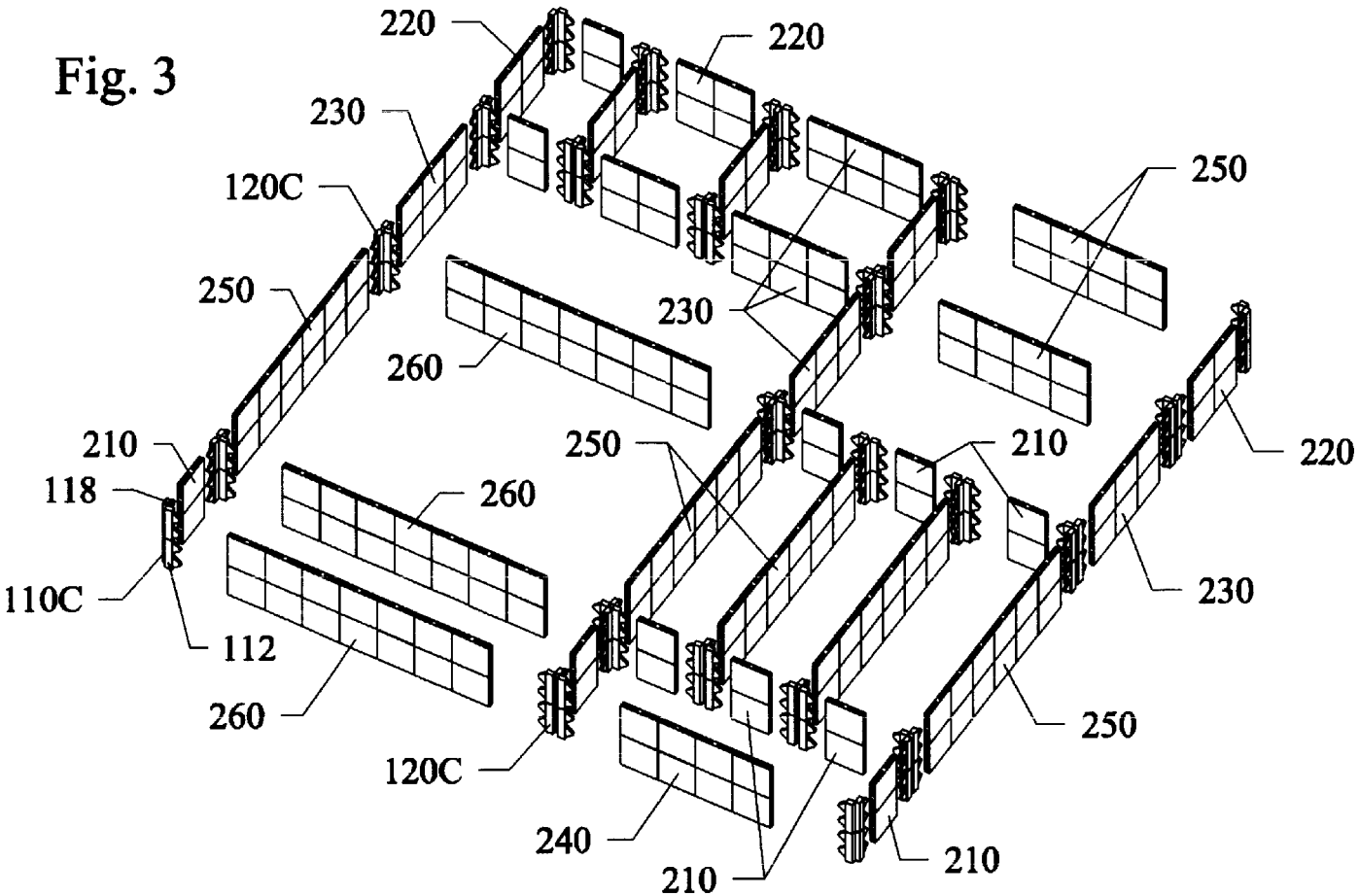
FIG. 3 shows an exploded view of the organizer of FIGS. 1–2.
Figure 5:
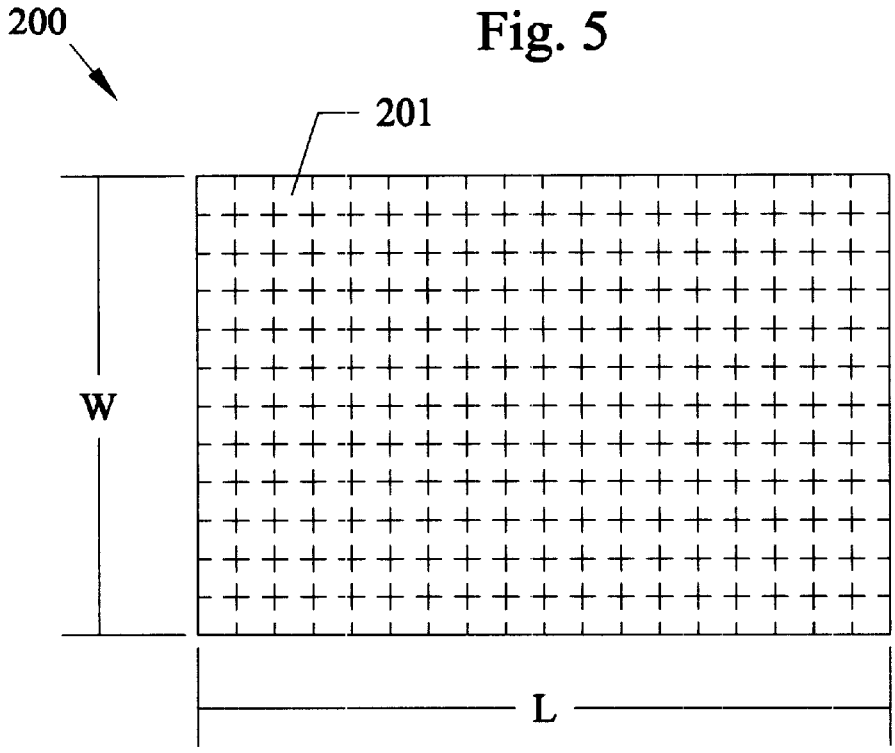
FIG. 5 shows a single sheet of pre-perforated wall sections.
Figure 6:
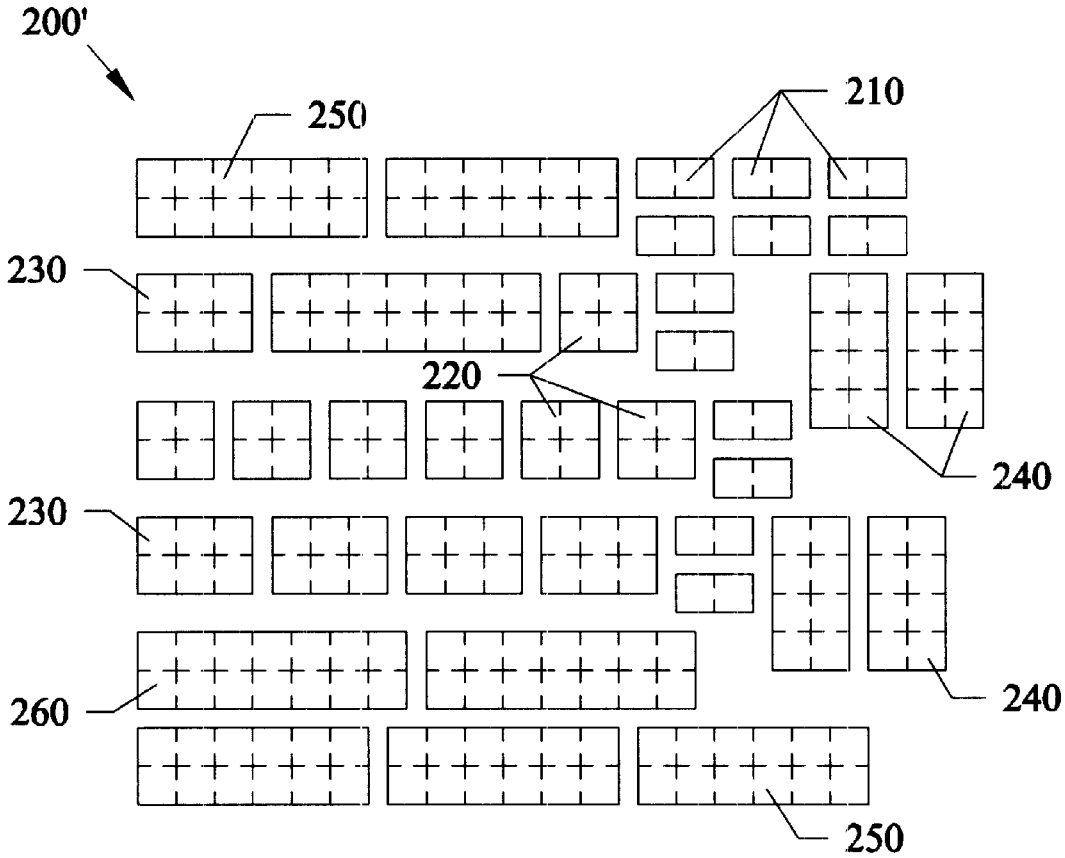
FIG. 6 shows the sheet of FIG. 5 with wall sections separated therefrom.
Figure 7:
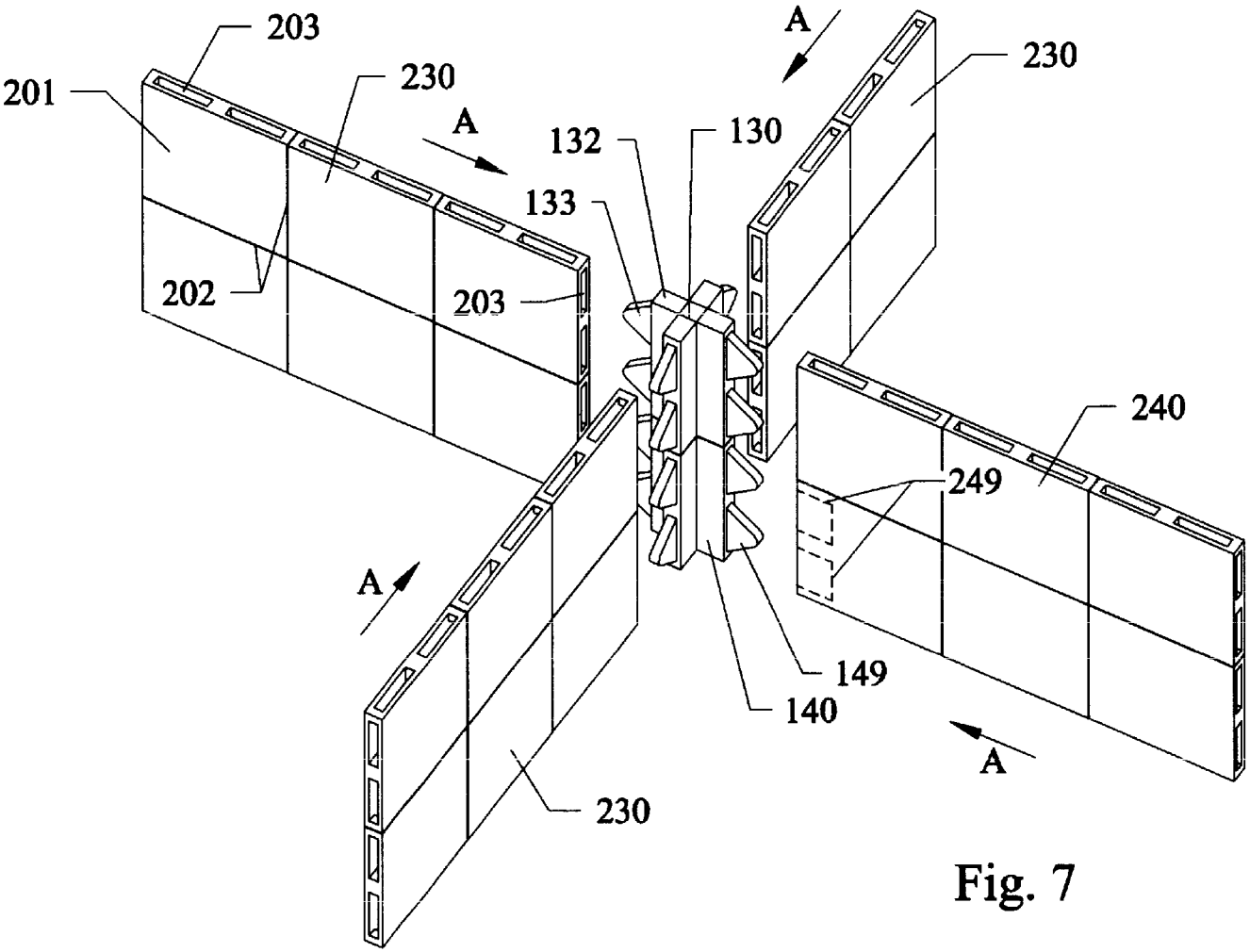
FIG. 7 shows wall sections of FIG. 6 ready to be assembled to corner reflectors.

FIG. 1 the novel invention organizer 1 assembled inside 20 of a drawer 10. FIG. 2 shows the organizer 1 of FIG. 1 separated from the drawer 10. FIG. 3 shows an exploded view of the organizer 1 of FIGS. 1–2. FIG. 4A shows a perspective view of a row of four prong comer connectors 100 attached to one another. FIG. 4B shows the row of individual comer connectors 110, 120, 130, 140 of FIG. 4A separated apart from one another along its axis. FIG. 4C shows the comer connectors of FIGS. 4A–4B with separated with some side tabs snapped off. FIG. 5 shows a single sheet 200 of pre-perforated wall sections. FIG. 6 shows the sheet 200 of FIG. 5 with wall sections separated therefrom. FIG. 7 shows wall sections of FIG. 6 ready to be assembled to comer reflectors.

Referring to FIGS. 5–7, a single plastic sheet board 200 of individual wall sections 201, can have any length and width (18 across, and 12 in width are shown for illustration purposes) that are pre-perforated (202 shown in FIG. 7) to allow any combination to be separated from the rest by being broken off, snapped off, and the like. Each individual section 201 can include dual side indentations along each of the four sides (203, 205, shown for example in FIG. 7). Each individual section 201 can be shaped like a rectangle, square, and the like, having dimensions of approximately ½ inch by approximately ½ inch to approximately 1 inch by approximately 1 inch with a thickness of approximately 1/16 of an inch to approximately ¼ of an inch. FIG. 6 shows an exemplary example 200' of various walls that were separated from the sheet 200 of FIG. 5. For example, two sections together 210, four sections together 220, six sections together 230, eight sections together 240, twelve sections together 250, and fourteen sections together 260 were separated along perforated sides 202 (FIG. 7) to form the selected various sized walls. Using pre-perforated sides for each of the wall sections allows an installer to customize the length, and height of the divider walls to be used.

Referring to FIGS. 4A–4C, a row of plastic connectors 100 can be mold formed. Pre-perforated edges PP1, PP2, PP3 between pairs of each of the connectors 110, 120, 130, 140 allows each one to be separated from another as needed. Additional pre-perforated edges within each pair can further allow the installer to separate each pair of the connectors 110–140 into smaller versions as needed. Each connector is cross-shaped with raised edges 112, 114, 116, 118 arranged approximately ninety degrees apart from one another. Each of the raised edges can have dual flat triangular tipped tabs/prongs 113, 115, 117, 119. The backs of each of the raised edges also can included pre-perforations for allowing each of the raised edges 112, 114, 116, 118 to be initially held to one another. Additionally, 113, 115, 117, 119 can be separated from the raised edges 112, 114, 116, 118 to allow for assembly configurations (not shown). For example, connector 110C in FIG. 4C has two edges 112, 118 still connected and perpendicular to one another with the other edges 114, 117 separated therefrom. Connector 120C FIG. 4C has three connectors 122, 124, 128 still connected to one another with edge 126 separated therefrom. Thus, the installer does not have to leave exposed edges on the comer connectors especially on the outer peripheral edges of the organizational system as shown by 110C, 120C of FIGS. 3 and 4C. Thus, the connectors do not create wasted space since the installer can customize which edges to be used.

Referring to FIGS. 3 and 7, wall sections 230 and 240 can be moved together in the direction of arrow A to be joined together by allowing side indentations 203, 205 in each of the respective wall sections 230, 240 to mateably attach to respective dual flat triangular tipped tabs/prongs (133 for example). The tabs/prongs can be formed so that they will tightly fit into side indentations 203, 205. Alternatively, the tabs/prongs can include side cut-outs (149 for example), that can snap into and catch on ledges formed within the indentations (249 for example) in order to have a tighter more permanent fit.

Figure 8:
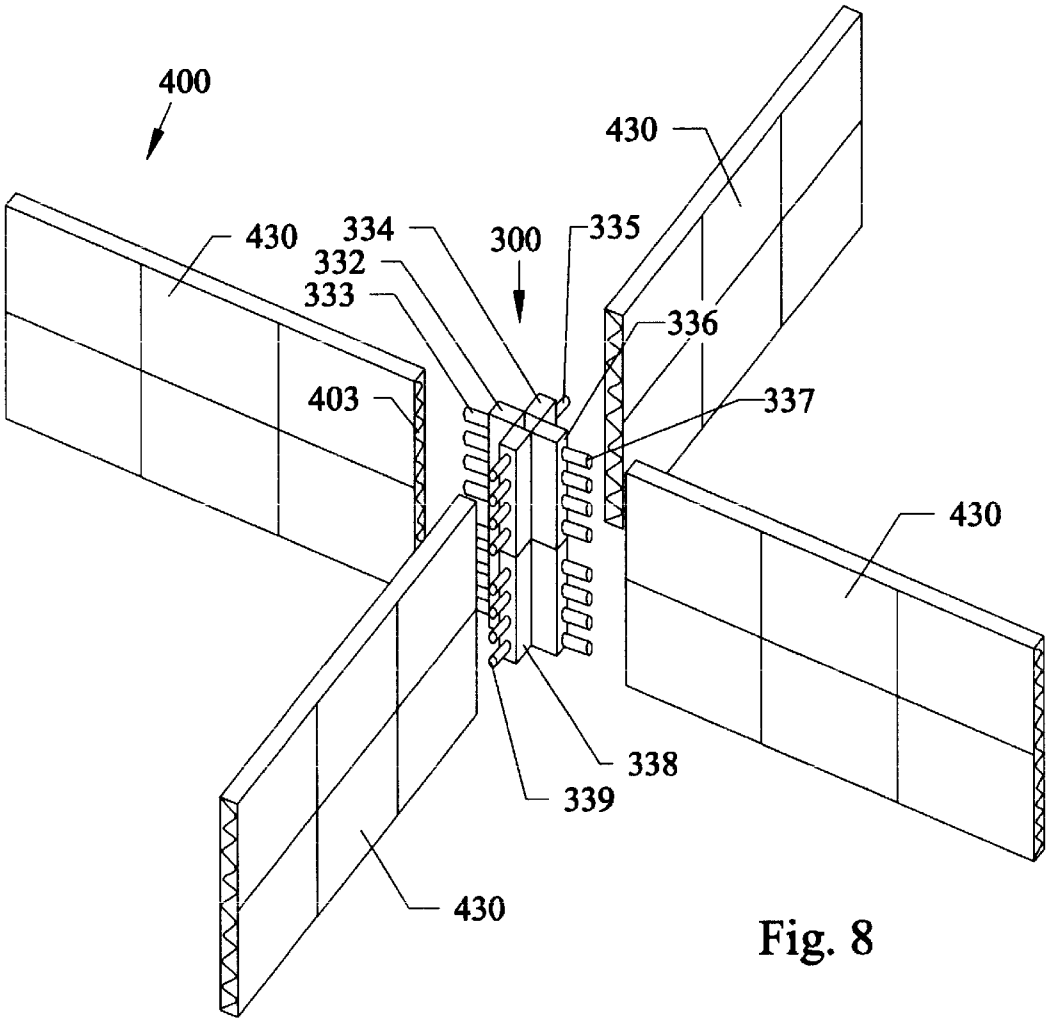
FIG. 8 shows another embodiment of using separated corrugated plastic wall sections ready to be assembled to comer reflectors.

FIG. 8 shows another embodiment of using separated corrugated plastic wall sections 430 ready to be assembled to another version of corner reflectors 300. Wall sections 430 can be formed from a sheet 400 (not shown) that is similar to sheet 200 of FIG. 5. Here sheet 400 and wall sections 430 can be formed from corrugated plastic that has spacing through 403 being similar to that used in corrugated cardboard. Connector 300 an have four edges 332, 334, 336, 338 arranged perpendicular to one another with backing being pre-perforated similar to that of connectors 100 previously described. Here, cylindrical prong tips 333, 335, 337, 339 extend from respective edges 332, 334, 336, 338 and are inserted into the side corrugated spacings 403 of wall sections 430 to form the wall dividers. The embodiment of FIG. 8 can be used to form drawer dividers to be used in the manner depicted in FIGS. 1–2.

Figure 9:
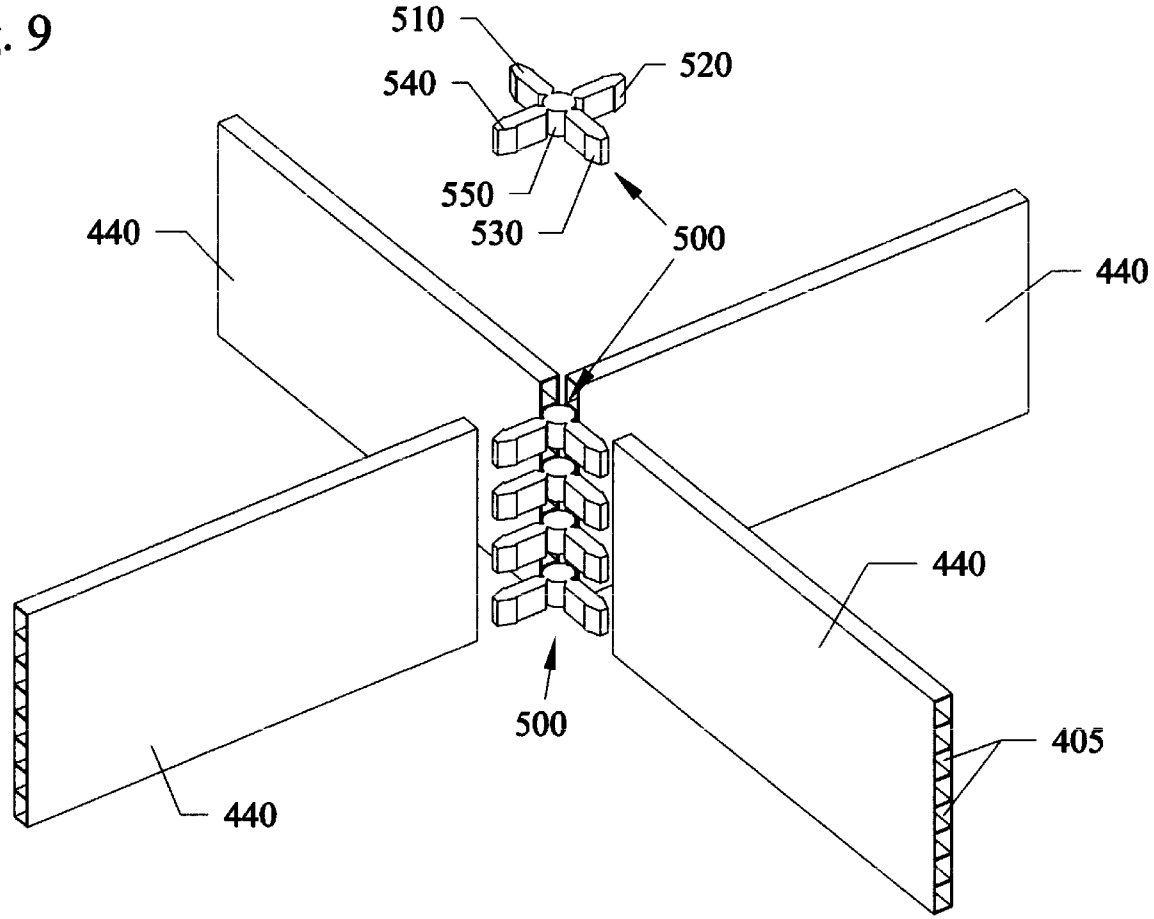
FIG. 9 shows another embodiment of using the separated corrugated plastic wall sections ready to be assembled to smaller separated comer connectors.

FIG. 9 shows another embodiment of using the separated corrugated plastic divider sections 440 ready to be attached to smaller separated corner connectors 500. Divider sections 440 can come from a larger sheet such as those previously described that has pre-perforations running therethrough. Each of the corner connectors 500 can be formed from molded plastic having appendages/prongs 510, 520, 530, 540 arranged in a cross pattern (perpendicular to one another) about a central member 550. Each of the connectors can be separately formed, or the connectors can be initially formed as being attached to one another in a row formation similar to the connectors previously described. Each of the appendages 510–540 can have a narrow tip portion that are insertable into the side corrugated longitudinal spacings 405 of divider sections 430 to form either wall dividers and/or floor dividers.

Figures 10A, 10B, 10C:
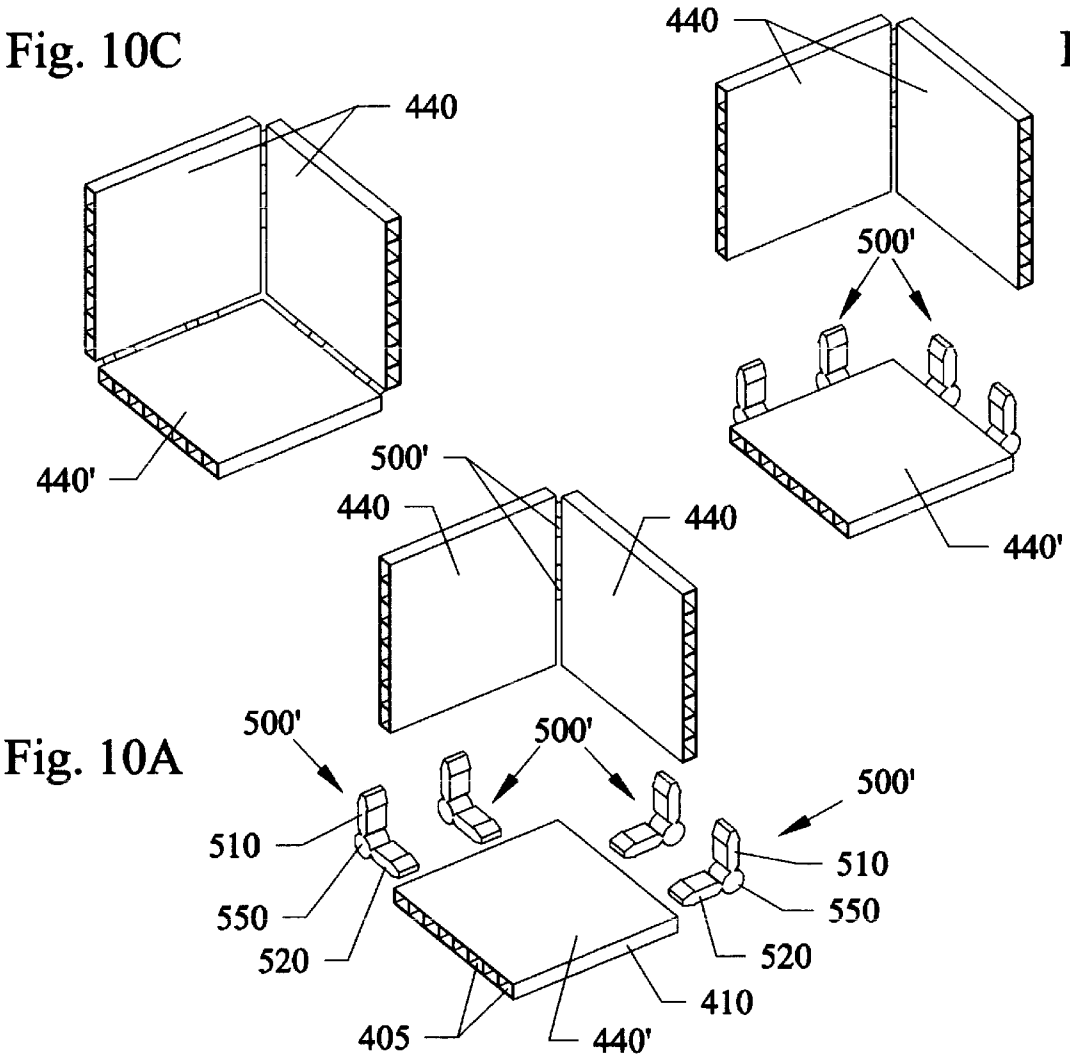
FIG. 10A shows an exploded view of an assembled divider, connectors and a backing(floor/wall).
FIG. 10B shows the connectors and backing of FIG. 10A attached to one another ready to be attached to the assembled divider.
FIG. 10C shows the assembled divider and backing attached to one another.

FIG. 10A shows an exploded view of an assembled divider having two sections 440 attached to each other by modified connectors 500', and separated modified connectors 500' and a backing(floor/wall) 440'. Sections 440, 440' can also corrugated plastic portions that were separated from a single sheet having pre-perforations running therethrough. Connectors 500 described and shown in FIG. 9 can have two prongs/appendages removed leaving two prongs/appendages 510, 520 perpendicular to one another both attached to central member 550. The corrugated plastic wall/floor sections can be soft enough to be pierced by the narrow tips of the prongs/appendages of the connectors 500', when the tips of the prongs/appendages are pushed into the sections 440, 440'. Thus, outer exterior sides 410 that are perpendicular to the parallel longitudinal spacings 405 can be soft enough to be pierced by the prongs/appendages 520 of connectors 500'.

FIG. 10B shows the modified connectors 550 and backing section 440' of FIG. 10A attached to one another ready to be attached to the assembled divider having two sections 440.

FIG. 10C shows the assembled divider of two sections 440 and backing 440' attached to one another. The backing 440' can be used as a floor where sections 440 are divider walls. Alternatively, backing 440' can be used as a rear wall where sections 440 are part of a shelf(s).

Figure 11:
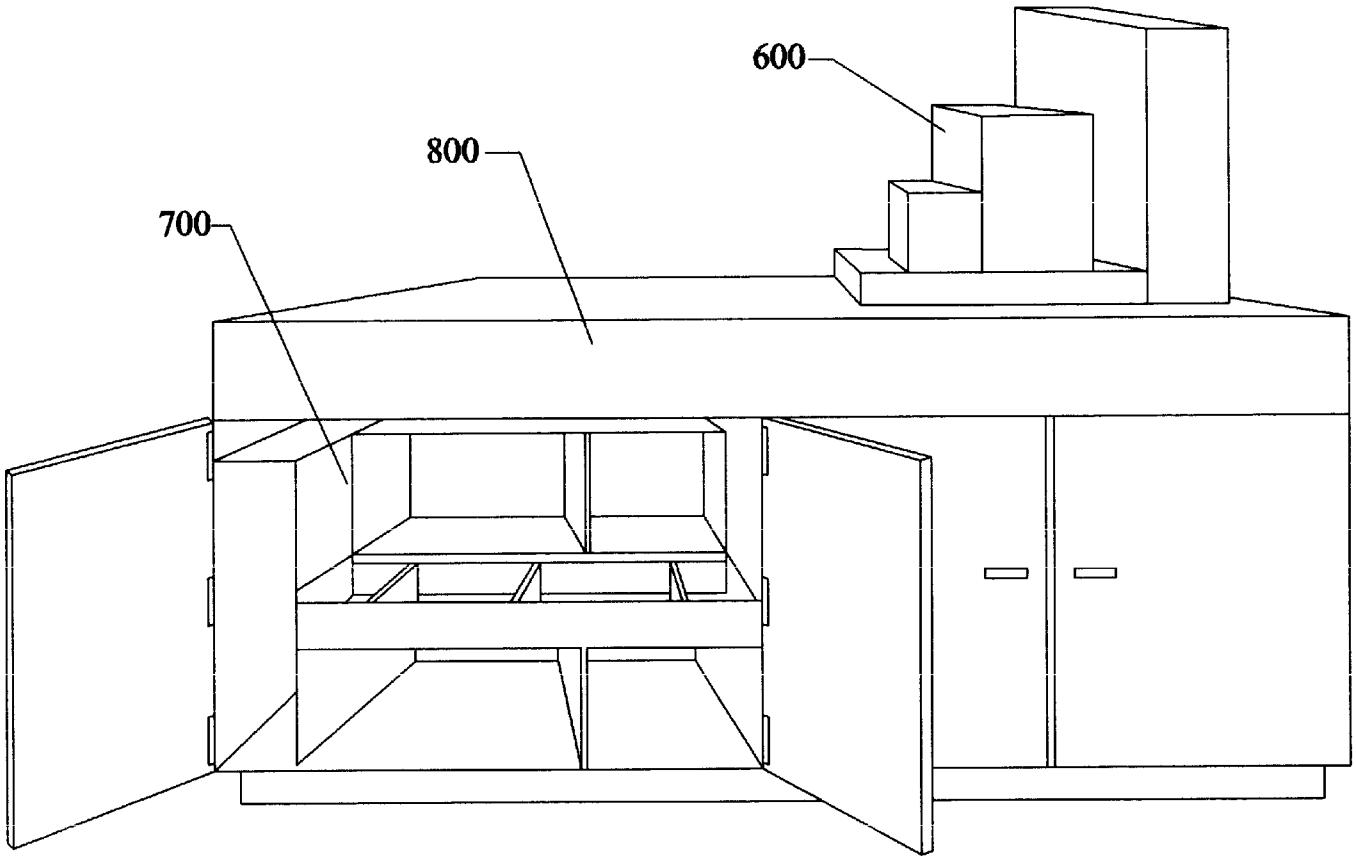
FIG. 11 shows an application of using the novel compartments of the subject invention as shelves above and below a countertop.

FIG. 11 shows an application of using the novel compartments 600, 700 of the subject invention as previously described as shelves above and below a countertop 800.

The system can also be reusable where the installer pulls apart the divider walls/floors when new sized compartments are needed. Alternatively, the prongs/tabs can be made to be snapped into mateable indentations to form permanent attached dividers.

While the embodiments describe an application as divider type walls for compartments, the assembled dividers can be turned on their sides so that the assembled dividers become assembled walls and/or floors for a shelf(s), and the backing can become a rear wall for the shelf(s).

Although the preferred embodiment describes using pre-perforated edges on the sheets and connectors, the invention can encompass other types of ways of allowing an installer to separate desired sized wall sections and corner pieces as needed, such as but not limited to forming a thinner plastic attachment point, forming cut-out edges, and the like.

While the preferred embodiment of FIGS. 1–2 shows each of the various walls having two rows of individual wall sections, one skilled in the art can have one row, and/or three or more rows depending on the depth height of the drawer. Similarly, when used as shelves, the depth of the shelves can vary depending on the compact space being used.

Although the preferred embodiment describes the tabs/prongs as being of various shapes such as flat triangular shaped and as prongs/appendages, the tabs/prongs have other shapes that allow for a mateable fit within respective indentations.

Different colored components such as having different colored sheets of materials (for example red, yellow, blue, green, white, black, and the like) can be used to assemble different colored compartments so that users can insert different items into the different compartments.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A method of making a divider organizer for compact spaces within drawers, comprising the steps of:

providing a planar plastic molded sheet having perforated portions along the sheet;

separating a first planar portion having side edges from the perforated portions of the sheet, the first planar portion having an indentation along one side edge;

separating a second planar portion having side edges from the perforated portions of the sheet, the second planar portion having an indentation along one side edge;

inserting a first prong extending from a single connector into the indentation along the one side edge of the first planar portion;

inserting a second prong extending from the single connector into the indentation along the one side edge of the second planar portion, the first prong and the second prong each having a central longitudinal axis, said axes being substantially perpendicular to each other to form a wall divider; and positioning the wall divider into a drawer as an organizer for the drawer.

2. The method of making of claim 1, further comprising the step of:

separating the single connector having the first and the second prongs from a row of molded plastic connectors wherein each of the connectors includes two prongs and the row includes perforations between each of the connectors.

3. The method of making of claim 1, further comprising the step of:

separating a third planar portion having side edges from the sheet, the third planar portion having an indentation along one side edge;

inserting a first prong extending from a second single connector into another indentation along another side edge of the first planar portion; and inserting a second prong extending from the second single connector into the indentation along the one side edge of the third planar portion to form a floor for the wall divider, wherein the wall divider and the floor divider are inserted into the drawer.

4. The method of claim 3, further comprising the step of:

separating the single connector and the second connector from a row of molded plastic connectors wherein each of the connectors includes at least two prongs and the row includes perforations between each of the connectors.

5. The method of claim 1, wherein the steps of inserting includes the steps of:

inserting a first pair of prongs extending from the single connector into the indentation along the one side edge of the first planar portion; and inserting a second pair of prongs extending from the single connector into the indentation along the one side edge of the second planar portion.

6. The method of claim 1, further comprising the step of:

separating the single connector from a row of molded plastic connectors wherein each of the connectors includes at least three prongs extending in different directions and the row includes perforations between each of the connectors.

7. A method of making a divider organizer for shelves and table tops, comprising the steps of:

providing a planar plastic molded sheet having perforated portions along the sheet;

separating a first planar portion having side edges from the sheet, the first planar portion having an indentation along one side edge;

separating a second planar portion having side edges from the sheet, the second planar portion having an indentation along one side edge;

inserting a first prong extending from a single connector into the indentation along the one side edge of the first planar portion;

inserting a second prong extending from the single connector into the indentation along the one side edge of the second planar portion to form a space wall divider, the first prong and the second prong each having a central longitudinal axis, said axes being substantially perpendicular to each other; and positioning the space divider into on at least one of a shelf and a table top.

8. The method of claim 7, further comprising the step of:

separating the single connector having the first and the second prongs from a row of molded plastic connectors wherein each of the connectors includes two prongs and the row includes perforations between each of the connectors.

9. The method of claim 7, further comprising the step of:

separating a third planar portion having side edges from the sheet, the third planar portion having an indentation along one side edge;

inserting a first prong extending from a second single connector into another indentation along another side edge of the first planar portion; and inserting a second prong extending from the second single connector into the indentation along the one side edge of the third planar portion to form a floor for the space divider.

10. The method of claim 7, wherein the steps of inserting includes the steps of:

inserting a first pair of prongs extending from the single connector into the indentation along the one side edge of the first planar portion; and inserting a second pair of prongs extending from the single connector into the indentation along the one side edge of the second planar portion.

11. The method of claim 7, further comprising the step of:

separating the single connector from a row of molded plastic connectors wherein each of the connectors includes at least three prongs extending in different directions and the row includes perforations between each of the connectors.

12. A method of forming an organizer comprising the steps of:

providing a molded plastic planar corrugated sheet with perforations along the sheet;

pulling separate planar pieces along the perforations from the sheet;

providing a row of molded plastic connectors, each connector having at least two prongs extending outward therefrom, wherein two of said prongs each having a central longitudinal axis, said axes being substantially perpendicular to each other, and the row having perforations between each of the connectors;

pulling connectors from the perforations in the row; and connecting the separate planar pieces together by inserting the prongs of the connectors into side indentations of the planar pieces; and forming an organizer wall divider for separating items from the connected planar pieces.

13. The method of claim 12, further comprising the step of:

inserting the divider into a drawer.

14. The method of claim 12, further comprising the step of:

placing the divider onto a table top.

15. The method of claim 12, further comprising the step of:

placing the divider on a shelf.

* * * * *